US007834724B2

(12) United States Patent
Rane et al.

(10) Patent No.: US 7,834,724 B2
(45) Date of Patent: Nov. 16, 2010

(54) ELECTROMECHANICAL INTERLOCK FOR ELECTRICAL PROTECTION DEVICES

(75) Inventors: Mahesh Jaywant Rane, Secunderabad (IN); Yatin Vilas Newase, Maharashtra (IN); Simhadri Ramalingeswara Rao Gupta, Andhrapradesh (IN)

(73) Assignee: General Electric Company, Schenectady, NY (US)

( * ) Notice: Subject to any disclaimer, the term of this patent is extended or adjusted under 35 U.S.C. 154(b) by 437 days.

(21) Appl. No.: 12/102,991

(22) Filed: Apr. 15, 2008

(65) Prior Publication Data

US 2009/0255787 A1 Oct. 15, 2009

(51) Int. Cl.
*H01H 67/02* (2006.01)
*H01H 9/00* (2006.01)

(52) U.S. Cl. ..... 335/120; 335/172

(58) Field of Classification Search ..... 335/120, 335/172, 174, 106, 14, 20
See application file for complete search history.

(56) References Cited

U.S. PATENT DOCUMENTS 1,814,826 A * 7/1931 Carpenter ..... 335/120
1,953,789 A * 4/1934 Thumim ..... 335/7
2,269,741 A * 1/1942 Seeger ..... 335/120
2,446,299 A * 8/1948 Nelsen ..... 335/120
2,452,065 A * 10/1948 Moran ..... 335/120
4,631,507 A * 12/1986 Guery et al. ..... 335/27
4,713,636 A * 12/1987 Lemmer et al. ..... 335/35
4,931,757 A * 6/1990 Lemmer et al. ..... 335/131
RE34,396 E * 10/1993 Wollenhaupt ..... 200/50.06
5,300,905 A * 4/1994 Kolbas et al. ..... 335/167
5,543,766 A * 8/1996 Bagalini ..... 335/177
5,821,876 A * 10/1998 Farrington et al. ..... 340/3.2
6,107,702 A * 8/2000 Bilac et al. ..... 307/125
6,570,269 B2 * 5/2003 McMillan et al. ..... 307/64
6,922,121 B2 * 7/2005 Kim ..... 335/167
7,233,220 B2 * 6/2007 Batteux ..... 335/179
2006/0145794 A1 * 7/2006 Batteux ..... 335/128

* cited by examiner

*Primary Examiner*—Anh T Mai
*Assistant Examiner*—Alexander Talpalatskiy
(74) *Attorney, Agent, or Firm*—Global Patent Operation; Stephen G. Midgley

(57) ABSTRACT

An interlock is presented which may be mechanically interconnected with a circuit breaker. The interlock toggles between a locked out position that causes the circuit breaker to trip and prevents closure thereof and a non-locked out position wherein the circuit breaker functions. The interlock includes a frame, a lockout actuator supported by the frame, a reset actuator also supported by the frame and a latching assembly. The latching assembly includes a lockout lever that is responsive to movement of the lockout actuator that is pivotably supported by the frame and a lockout trip rod responsive to movement of the lockout actuator. Also provided is a reset lever that is responsive to movement of the reset actuator and that is also pivotably supported by the frame. The reset lever is configured to prevent movement of the lockout actuator without movement of the reset lever and wherein the lockout trip rod is configured for movement between a locked out position and a non-locked out position.

10 Claims, 4 Drawing Sheets

ELECTROMECHANICAL INTERLOCK FOR ELECTRICAL PROTECTION DEVICES

BACKGROUND OF THE INVENTION

1. Field of the Invention

The subject matter described herein relates generally to power distribution systems and, more particularly, to an apparatus for locking out electrical protection devices.

2. Related Art

In power distribution systems, power is distributed to various loads and is typically divided into branch circuits, which supply power to the loads. The branch circuits include power distribution equipment such as transformers that step down the supply voltage for use by a load, e.g., a specific piece of electrical equipment.

Abnormal power conditions, such as faults, regularly occur in the power distribution system. These faults can cause severe damage to the system. To reduce or prevent damage, it is known to provide circuit protective devices to protect the various loads, as well as the power distribution equipment. One example of a circuit protective device is a circuit breaker that is employed to prevent high currents from being past to the load and/or the power distribution equipment in the event of a fault.

It is further known to utilize lockout mechanisms for circuit breakers that interact with the circuit breaker operating mechanisms to prevent the breaker contacts from being closed until the lockout mechanism is reset. Such lockout mechanisms also include solenoids having biased plungers that immediately return to their home position when the solenoid is de-energized.

Such lockout mechanisms suffer from the drawback of requiring manual intervention to reset the mechanism and enable the closing of the circuit breaker. These lockout mechanisms also suffer from the drawback of requiring continuous energizing of the solenoid to maintain the circuit breaker in the desired lockout state. In circuits having protection systems incorporating such mechanisms, loss of power and/or loss of communication within the protection system can result in unwanted changes to the lockout state of the breakers of the protection system. Such changes can occur regardless of the duration of the loss of power and/or loss of communication, and regardless of the extent of the loss of power and/or loss of communication throughout the system.

Accordingly, it is desired to provide an apparatus for locking out circuit protection devices that ameliorates the disadvantages and deleterious effects associated with prior art devices.

BRIEF DESCRIPTION OF THE INVENTION

In accordance with an embodiment of the present invention, an interlock is mechanically interconnected with a circuit breaker. The interlock toggles between a locked out position that causes the circuit breaker to trip and prevents closure thereof and a non-locked out position wherein the circuit breaker functions. The interlock comprises a frame, a lockout actuator supported by the frame, a reset actuator also supported by the frame and a latching assembly. The latching assembly comprises a lockout lever that is responsive to movement of the lockout actuator that is pivotably supported by the frame and a lockout trip rod responsive to movement of the lockout actuator. Also provided is a reset lever that is responsive to movement of the reset actuator and that is also pivotably supported by the frame. The reset lever is configured to prevent movement of the lockout actuator without movement of the reset lever and wherein the lockout trip rod is configured for movement between a locked out position and a non-locked out position.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns an interlock device for circuit protection that reduces the risk of damage to a circuit in the event of a loss of power and/or a loss of communication within the circuit.

Figure 1:
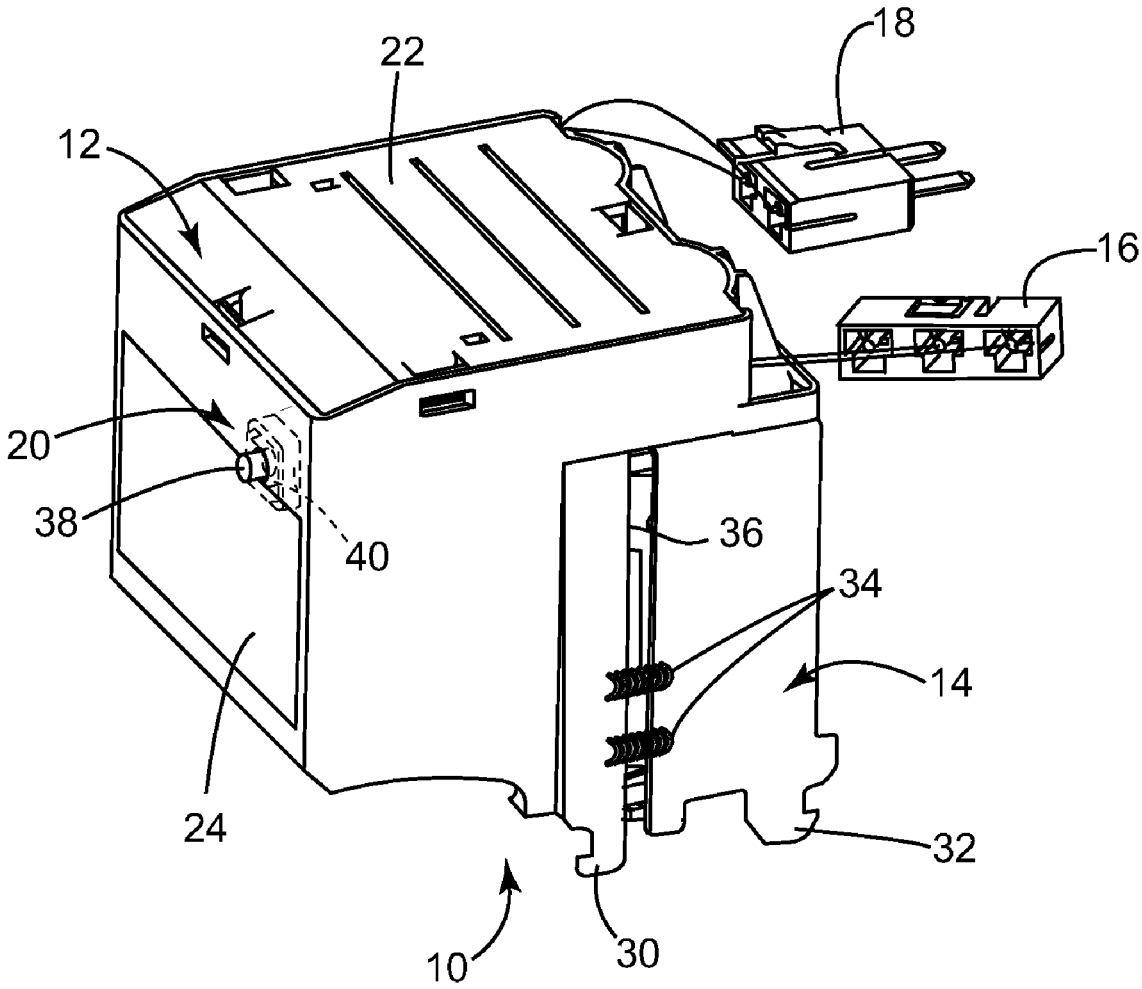
FIG. 1 is a perspective view of an interlock device in accordance with an exemplary embodiment of the present invention.

Referring now to FIG. 1, an interlock in accordance with one embodiment of the present invention is illustrated generally at 10. In this embodiment, the interlock 10 comprises a frame 12, a mounting clasp 14, a power connector 16, an interlock status connector 18 and a manual reset button assembly 20.

Figure 2:
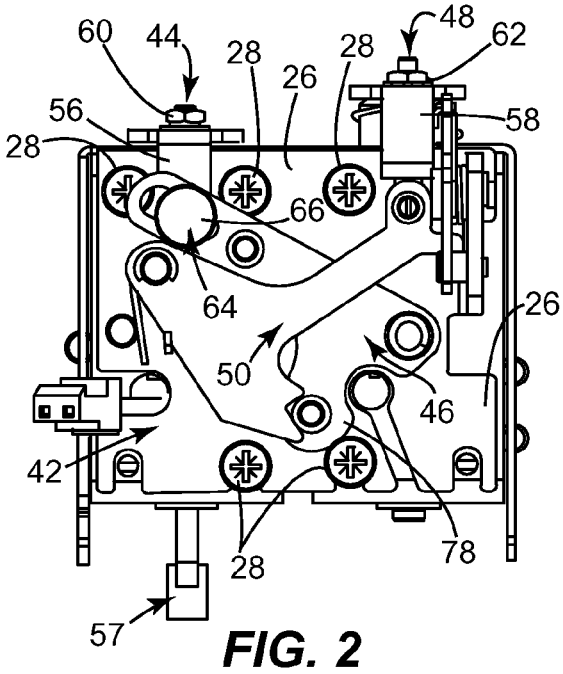
FIG. 2 is a rear view of the device of FIG. 1 showing a latching assembly in a lockout position.

The frame 12 may comprise a polymeric material and a top plate 22 is shown which may also comprise a polymeric material. The top plate 22 may comprise U-shaped snaps that may be fitted to the frame 12. The frame 12 may be fastened, as shown in FIG. 2, by screws 28 to solenoid brackets (not numbered).

The mounting clasp 14 may comprise a steel alloy and comprises a known construction for mounting on a circuit breaker (not shown) using standard slot available for a shunt device or an under voltage device mounting. As such, the mounting clasp may be affixed to the frame 12 and comprises hook portions 30, 32, springs 34 and a split portion 36.

The power connector 16 and status connector 18 each comprise a known construction and are connected in circuit with a lockout circuit as will be described in more detail below in connection with FIG. 6.

The manual reset button assembly 20 comprises a button 38 that is supported by the front plate 24 via a suitable support structure 40 and that is interconnected with a latching assembly described in detail below.

Referring now to FIG. 2, one exemplary embodiment of a latching assembly is shown generally at 42 and comprises any suitably strong and durable material such as a steel. The latching assembly 42 comprises a lockout actuator 44, a lockout lever 46, a reset actuator 48 and a reset lever 50.

The lockout actuator 44 and reset actuator 48 are each movable, e.g., in response to energization of solenoid coils 52, 54 (see FIG. 6), which are described in more detail below. The lockout actuator 44 may be connected with a lockout actuator connector 56 via a fastener 60 and with a lockout trip rod 57. The reset actuator 48 may be connected with a reset actuator connector 58 via a fastener 62. The lockout actuator connector 56 comprises an actuator connector pin 64 that includes an enlarged diameter head 66.

Figure 3:
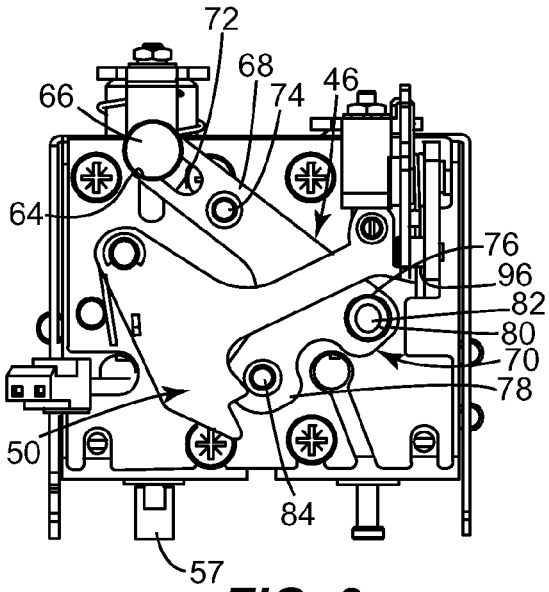
FIG. 3 is a rear view of the device of FIG. 1 showing the latching assembly in a reset position.

Referring also to FIG. 3, the lockout lever 46 comprises an arm portion 68 and a working portion 70. The arm portion 68 comprises an elongated slot 72 wherethrough the actuator connector pin 64 extends and a stop roller 74 for preventing improper engagement between the lockout lever 46 and reset lever 50.

The working portion 70 comprises a hub portion 76 and a finger portion 78. The hub portion 76 comprises an aperture 80 wherethrough a lockout lever pin 82 extends. The lockout lever pin 82 is connected with the rear plate 26 of the frame 12 and functions to allow pivotable motion of the lockout lever 46. The finger portion 78 comprises a roller 84 that is configured to engage the reset lever 50 as described below.

Figure 4:
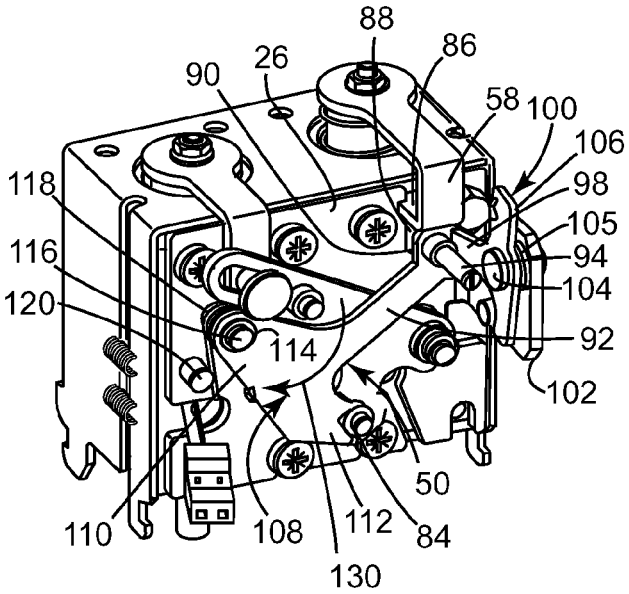
FIG. 4 is a rear perspective view of the device of FIG. 1 showing the latching assembly in a lockout position.

Referring now to FIG. 4, the reset actuator connector 58 comprises a tab portion 86 that extends into a guide slot 88 of the rear plate 26 and is disposed in contact with a terminal portion 90 of a leg portion 92 of the reset lever 50. Referring now also to FIGS. 3 and 7, the leg portion 92 comprises an adjustable pin 94 that functions to actuate a status switch 95 (FIG. 7) along with a tab 96 (FIG. 3) that is configured to be engageable by an extension 98 of a manual reset lever 100. The status switch 95 comprises a status switch lever 99 that is movable by the adjustable pin 94 and is shown in schematic diagram of FIG. 6, described below.

The manual reset lever 100 may be rotatably connected to a support plate 102 via a pin 104 and biased by a spring 105. The manual reset lever 100 comprises, along with the extension 98, a strike plate 106. The strike plate 106 may be configured to engage an actuator (not shown) interconnected with the manual reset button 38 (FIG. 1).

Extending from the leg portion 92 of the reset lever 50 is a foot portion 108 that comprises a heel 110 and toe 112. The heel 110 comprises an aperture 114 wherethrough a pin 116 extends which is spaced and biased by a spring 118 that, at one end thereof, engages a stop 120.

Figure 5:
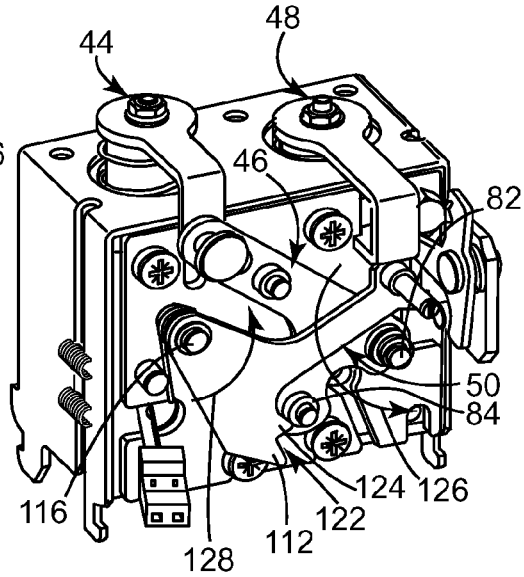
FIG. 5 is a rear perspective view of the device of FIG. 1 showing the latching assembly in a reset position.

Turning now to FIG. 5, toe 112 comprises a guide portion 122 that functions to engage the roller 84 of the lockout lever 46. The guide portion 122 comprises a tooth portion 124 which functions to prevent movement of the lockout lever 46 without movement of the reset lever 50 as described in more detail below.

In operation and referring to both FIGS. 4 and 5, upon movement of the lockout actuator 44, the lockout lever 46 will be urged in a rotational direction shown by arrow 126 about pin 82, in turn, roller 84 will be moved along the guide 122 of the reset lever 50 and over tooth 124. Correspondingly, movement of the reset actuator 50 in the direction of arrow 128 about pin 116, via spring 118, locks the roller 84 of the lockout lever 46 against tooth 124 of the reset lever 50 and thereby insuring that the latching assembly will be in the lockout position as shown in FIG. 4 and will not move to the non-locked out position or reset position shown in FIG. 5 unless the reset lever is moved in the direction of arrow 130 shown in FIG. 4. Movement of the reset lever 50 will occur through either movement of the manual reset lever 100 via button 38 (FIG. 1) or via movement of the reset actuator 48.

As shown in FIGS. 2 and 3, which correspond with the lockout position and reset positions of the locking assembly 42 shown by FIGS. 4 and 5 described above, the lockout trip rod 57 is moved upon movement of the lockout actuator 44 between the lockout extended position as shown in FIG. 2 and the non-locked out position or reset position of FIG. 3. In the extended position, the lockout trip rod 57 will trip a circuit breaker (not shown) and prevent it from functioning.

Figure 6:
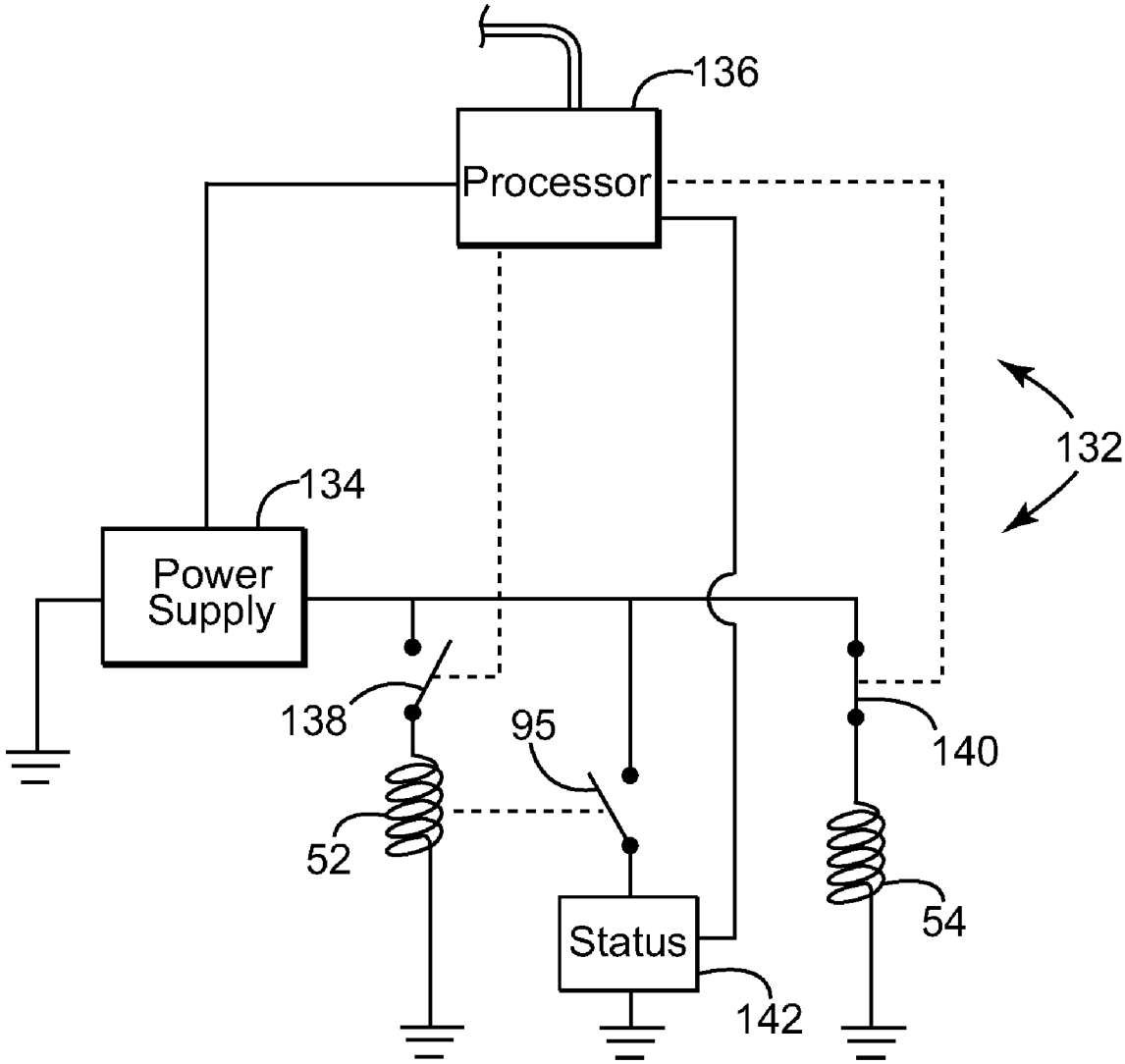
FIG. 6 is a circuit diagram showing a circuit usable with the interlock device of FIG. 1.
Figure 7:
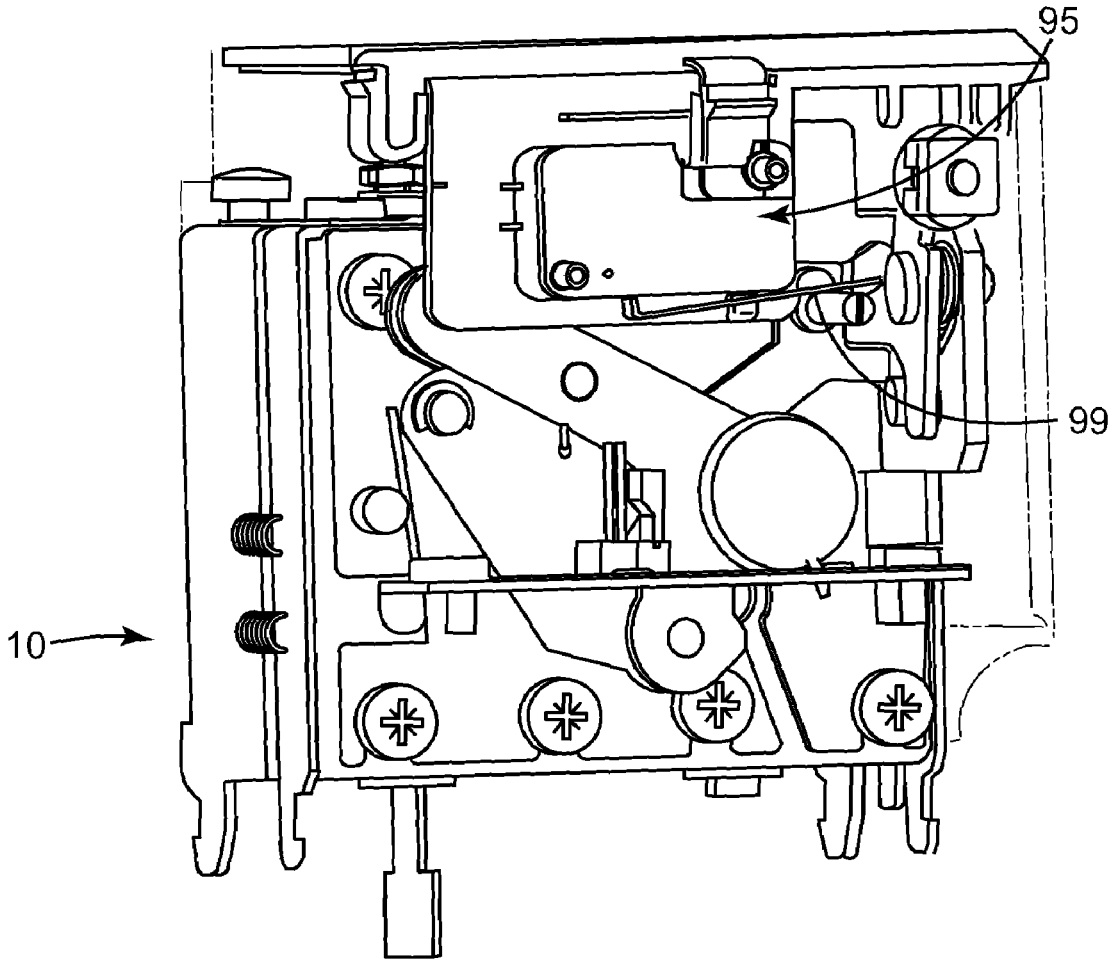
FIG. 7 is another rear perspective view of the device of FIG. 1 showing the latching assembly and a status switch.

An interrupt circuit usable with the interrupt device 10 is shown generally at 132 in FIG. 6. The interrupt circuit 132 comprises, along with lockout solenoid 52, reset solenoid 54 and status switch 95, a power supply 134, a processor 136, a lockout switch 138, a reset switch 140, and a status circuit 142. The lockout switch 138 may be configured to be normally open but closable in response to a command from the processor 136. Upon closing of the lockout switch 138, the lockout solenoid 52 will be energized by the power supply 134 which will move the lockout actuator 44 (FIG. 5) and the lockout lever 46 (FIG. 5) to a lockout position as described above. The status switch 95 may also be closed upon energization of the lockout solenoid coil 52 thereby enabling the status circuit 142 to notify processor 136 of the lockout position. The reset switch 140 may be a normally closed switch to maintain energy to the reset coil 54. Upon notification to the processor 136 of the lockout position, the processor may open switch 140 thereby de-energizing the reset coil 54, in turn, moving the reset actuator 48 and the reset lever 50 to the lockout position.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. An interlock mechanically interconnected with a circuit breaker, the interlock toggling between a locked out position that causes the circuit breaker to trip and prevents closure thereof and a non-locked out position wherein the circuit breaker functions, the interlock comprising:

a frame;

a lockout actuator supported by the frame;

a reset actuator supported by the frame;

a latching assembly comprising:

a lockout lever responsive to movement of the lockout actuator being pivotably supported by the frame;

a lockout trip rod responsive to movement of the lockout actuator; and a reset lever being responsive to movement of the reset actuator and also being pivotably supported by the frame, the reset lever configured to prevent movement of the lockout actuator without movement of the reset lever;

wherein the lockout trip rod is configured for movement between a locked out position and a non-locked out position; a manual reset lever responsive to movement of a reset button; a reset lever pin and wherein the reset lever comprises: a leg portion interconnected to the reset actuator, the leg portion having a flange for engaging the status switch lever; and a foot portion extending from the leg portion and the foot portion comprising:

a heel comprising an aperture to receive the reset lever pin; and a toe portion comprising a guide portion, the guide portion having a tooth portion; and a spring mounted to the reset lever pin and configured to rotatably bias the leg portion and, in turn, the interlock to the lockout position.

2. The interlock of claim 1, wherein the reset lever is biased to a locked out position and the lockout actuator is biased to a non-locked out position.

3. The interlock of claim 1, further comprising:

a lockout solenoid coil configured to move the lockout actuator when energized; and a reset solenoid coil configured to move the reset actuator when energized.

4. The interlock of claim 3, further comprising:

a status circuit configured to monitor and provide status of whether the interlock is in a lockout position.

5. The interlock of claim 4, wherein the status circuit comprises a status switch that is actuated upon energization of the lockout solenoid coil.

6. The interlock of claim 5, further comprising:

a lockout switch in series with the lockout solenoid coil;

a reset switch in series with the reset solenoid coil; and a processor connected in circuit to control actuation of the lockout switch and the reset switch.

7. The interlock of claim 6, wherein the lockout switch and the reset switch are also configured to be actuated by the latching assembly.

8. An interlock mechanically interconnected with a circuit breaker, the interlock toggling between a locked out position that causes the circuit breaker to trip and prevents closure thereof and a non-locked out position wherein the circuit breaker functions, the interlock comprising:

a frame;

a lockout actuator supported by the frame;

a reset actuator supported by the frame;

a latching assembly comprising:

a lockout lever responsive to movement of the lockout actuator being pivotably supported by the frame;

a lockout trip rod responsive to movement of the lockout actuator; and a reset lever being responsive to movement of the reset actuator and also being pivotably supported by the frame, the reset lever configured to prevent movement of the lockout actuator without movement of the reset lever;

wherein the lockout trip rod is configured for movement between a locked out position and a non-locked out position;

a manual reset lever responsive to movement of a reset button;

a reset lever pin and wherein the reset lever comprises:

a leg portion interconnected to the reset actuator, the leg portion having a flange for engaging the status switch lever; and a foot portion extending from the leg portion and the foot portion comprising:

a heel comprising an aperture to receive the reset lever pin; and further comprising a lockout lever pin and wherein the lockout lever comprises:

an arm portion interconnected with the lockout actuator; and a working portion extending from the arm portion and the working portion comprising:

a hub portion comprising an aperture for receiving the lockout lever pin;

a finger portion comprising a roller extending therefrom and the roller being configured to engage the guide portion of the reset lever and wherein the roller is prevented by the tooth portion from allowing movement of the lockout lever when in the lockout position unless the reset lever is moved.

9. The interlock of claim 8, wherein:

the lockout actuator comprises a lockout actuator connector that, in turn, comprises a lockout connector pin and wherein the arm portion comprises an elongated slot wherethrough the lockout connector lockout connector pin extends; and the reset actuator comprises a reset actuator connector that is connected between the reset actuator and the leg portion of the reset lever.

10. The interlock of claim 9, wherein the frame comprises a plate comprising:

a lockout actuator connector slot for receiving a free end of the lockout actuator connector; and a reset actuator connector slot for receiving a free end of the reset actuator connector.

* * * * *

UNITED STATES PATENT AND TRADEMARK OFFICE

CERTIFICATE OF CORRECTION

PATENT NO. : 7,834,724 B2
APPLICATION NO. : 12/102991
DATED : November 16, 2010
INVENTOR(S) : Rane et al.

It is certified that error appears in the above-identified patent and that said Letters Patent is hereby corrected as shown below:

In Column 6, Line 30, in Claim 9, after "lockout connector" delete "lockout connector".

Signed and Sealed this
Fifth Day of April, 2011

David J. Kappos

David J. Kappos
*Director of the United States Patent and Trademark Office*